United States Patent [19]

Berger et al.

[11] Patent Number: 4,478,644

[45] Date of Patent: Oct. 23, 1984

[54] PROCESS AND APPARATUS FOR HYDROLYZING CELLULOSE MATERIAL

[75] Inventors: Pierre Berger, Saint-Etienne; Maurice Gelus, Le Creusot, both of France

[73] Assignee: Creusot-Loire, Paris, France

[21] Appl. No.: 486,163

[22] Filed: Apr. 15, 1983

[30] Foreign Application Priority Data

Apr. 15, 1982 [FR] France ..... 82 06473

[51] Int. Cl.[3] ..... C13K 1/00

[52] U.S. Cl. ..... 127/1; 127/37

[58] Field of Search ..... 127/1, 36, 37; 425/204, 425/205

[56] References Cited

U.S. PATENT DOCUMENTS

| | | | |
|---|---|---|---|
| 2,681,871 | 6/1954 | Wallace | 127/37 |
| 3,751,527 | 8/1973 | Bortnick | 425/205 |
| 3,947,169 | 3/1976 | Wolff et al. | 425/205 |
| 4,316,747 | 2/1982 | Rugg et al. | 127/37 |
| 4,400,218 | 8/1983 | Koch et al. | 127/37 |

*Primary Examiner*—Richard V. Fisher
*Assistant Examiner*—Karen L. Hodson
*Attorney, Agent, or Firm*—Pollock, Vande Sande & Priddy

[57] ABSTRACT

Process and device for hydrolyzing cellulose material in an extruder with two parallel screws in which the material introduced in the moist condition and, transported by the screws is malaxated, heated to a temperature of above 200° C. in the downstream part of the extruder where it is contacted with an acid solution and progressively compressed, to a pressure higher than the saturated vapor pressure of the liquid phase of the hydrolyzed material at the temperature reached in the downstream part and maintained by a control device for the evacuation of the material. According to the invention, there is provided in the control device for the evacuation of the material, a separation of the liquid phase and of the solid phase from hydrolyzed material with maintenance of the output pressure, through the use for this purpose of a second extruder comprising two screws with axes perpendicular to that of the hydrolysis extruder, rotated within a sleeve into the central part of which the hydrolyzed material coming from the first extruder is discharged and in which a pressure is maintained higher than the saturated vapor pressure of the liquid phase by regulating the extrusion characteristics to form, at the downstream end of the output extruder, a plug of compressed material fluid-tight at said pressure, the latter being regulated by means of a pressure reducing valve controlling the evacuation of the liquid phase concentrated in the upstream part of the extruder and in which glucose formed by hydrolysis is dissolved.

14 Claims, 2 Drawing Figures

PROCESS AND APPARATUS FOR HYDROLYZING CELLULOSE MATERIAL

The invention relates to a process and an apparatus for hydrolyzing cellulose material by passing the latter through an extruder.

PRIOR ART

For a long time processes of saccharification by dilute acids of the cellulose contained in cellulosic materials have been known, materials such as, for example, wood, old paper or bio-mass waste material.

In the BERGIUS process, the fragmented wood is treated with 40% hydrochloric acid and the carbohydrate obtained is subjected to hydrolysis with dilute acid.

In the SCHOLLER process, a percolation under pressure of the cellulosic material is carried out, in which the cellulosic material is passed in countercurrent through several perculators arranged in series.

In the two cases, the installations comprise a large number of laborious and cumbersome apparatuses and can only be profitable for large-scale production.

It has also been proposed recently to carry out the hydrolysis reaction in an extruder. The cellulose material reduced into divided form, sawdust, for example, is introduced in the moist condition at the upstream end of the sleeve of an extruder comprising two rotating parallel screws which transport the material to the downstream end of the sleeve. The latter is heated so that, in the downstream part, the transported material reaches a temperature of the order of 240° C. The water is separated by evaporation and can be removed through the upstream end. The material hence becomes denser and is gradually compressed in the course of its transport downstream, and the pressure in the output orifice can reach 35 bars. The material is subjected to intense malaxation under the action of the screws, at the same time to a rise in temperature and pressure, and is contacted with a sulphuric acid solution introduced into the downstream part of the sleeve. The cellulose is then converted very rapidly into glucose which is drawn towards the output orifice, the latter being closed by a valve or gate intended to control the removal of the hydrolysed material by maintaining the pressure at a value higher than the saturated vapour pressure of water at the output temperature. In this way, the amount of water drawn downstream with the material remains in the form of a liquid phase in which the glucose formed by hydrolysis is dissolved thereby constituting a syrup.

The mass of material evacuated at the outlet is hence constituted by solid residues containing lignin, associated with a liquid phase containing dissolved glucose and residual acid. The plug thus formed at the downstream end of the sleeve is removed discontinously through the valve into an expansion chamber acting as a cyclone separator, in which are recovered a glucosed paste containing sugars, lignin, unreacted cellulose, furfural and condensed water, the greater part of the water escaping in the form of steam at the upper part of the expansion chamber.

In spite of the advantages contributed by the use of an extruder for carrying out the hydrolysis reaction, this process has therefore the drawback of providing discontinuously all the solid or pasty products in the same stream from which it is then necessary to extract the sugars after neutralisation by a known process.

The sugars must then be extracted by washing the solid residue, which has the drawback of lowering the concentration of the hydrolysate.

SUMMARY OF THE INVENTION

It is an object of the invention to provide improvements in this process and a novel installation at the outlet of which there is obtained continuously on the one hand a glucosed syrup from which it is easy to extract the sugars and on the other hand a solid residue only containing a small portion of the sugars formed.

In accordance with the invention, the device for controlling the removal under pressure of the hydrolysed material is constituted by an outlet extruder arranged transversely to an hydrolysis extruder and comprising also at least two screws rotated inside a sleeve provided in its central part, with an inlet orifice for the hydrolysed material coming from the hydrolysis extruder, at its downstream end, in the direction of transportation of the screws, with an extrusion die for the removal of the solid phase of the material in the form of a continuous plug fluid tight at the pressure reached in the sleeve and, at its upstream end, with an evacuation orifice for the liquid phase expelled by the compression and containing the dissolved glucose, said upstream orifice being provided with a pressure-reducing valve regulated to a pressure higher than the saturated vapour pressure.

Thus, through the use for the control of the evacuation of the material, of an output extruder transverse to the hydrolysis extruder, there is produced in the output extruder a separation of the liquid phase and of the solid phase of the hydrolysed material with maintenance of the output pressure; the solid phase, drawn downstream by the rotation of the screws, is extruded in a die to form a continuous plug whilst the liquid phase containing the dissolved glucose and expelled by the compression is concentrated in te upstream part whence it is removed through an orifice provided with a pressure-reducing valve which is regulated to a pressure above the saturated vapour pressure, the extrusion characteristics being adjusted to obtain in the die a plug of solid material compressed and fluid tight at this pressure.

BRIEF DESCRIPTION OF THE DRAWINGS

The invention will be better understood from the description of a particular embodiment given by way of example and shown in the accompanying drawings, this embodiment being of course intended purely for non-limiting illustration.

DETAILED DESCRIPTION

Figure 1:
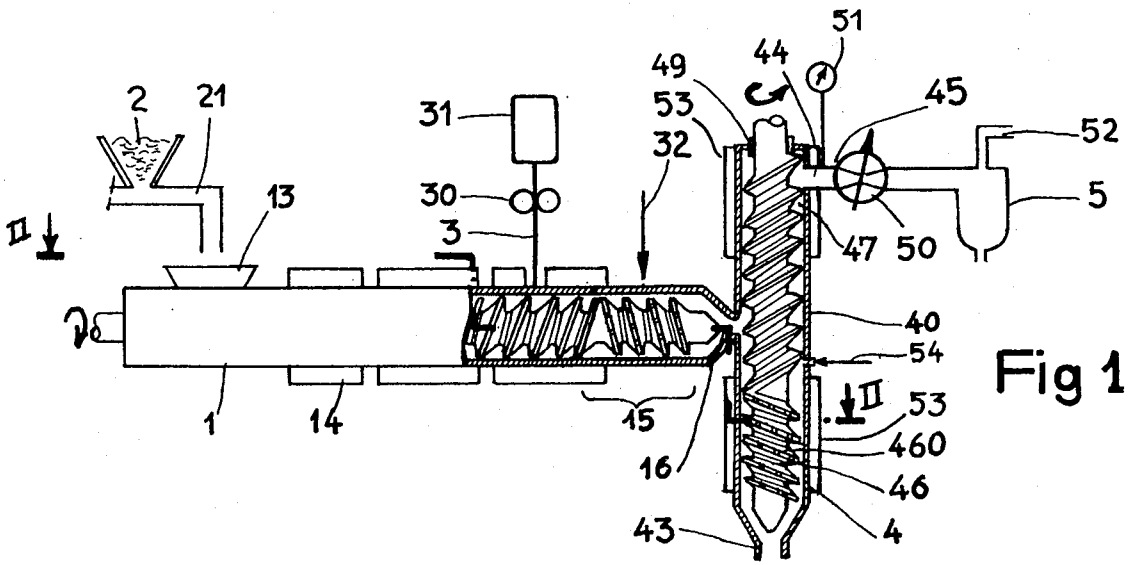
FIG. 1 shows the embodiment of the device in elevation, in section through a plane passing through the axis of one screw of the extruder.

In the Figures, there is shown by way of example an extruder 1 with two screws for the production, in known manner, of the hydrolysis reaction.

The extruder hence comprises two parallel screws 11 and 12 rotated by a motor (not shown) within the sleeve 1 which envelops them. The latter is provided, at its upstream end in the direction of transport of the screws, with a feed orifice 13 through which cellulosic material 2 is introduced, through feed regulating means 21.

In a particular embodiment, it may be advantageous to use screws whose construction permits fibre separation and/or washing of the lignocellulose material, as described in French Pat. Nos. 2.319.737 and 2.451.763, respectively dated July 31, 1975 and Mar. 22, 1979, by Applicant.

The cellulosic material 2 may be introduced into the hydrolysis extruder in the form of wood shavings, as has been indicated in the preceding Patents already mentioned.

Along sleeve 1 are positioned heating or cooling enclosures which permit regulation of the rise in temperature from upstream to downstream, the latter having to reach a value of the order of 240° C. at the downstream end.

Into the downstream part of the hydrolysis extruder is introduced a dilute acid solution, normally sulphuric acid, through a pipe 3 provided with a metering pump 30, from a reservoir 31. On the other hand, a pipe 32 enables the introduction of a liquid phase or of steam close to the outlet of hydrolysis extruder, to regulate, if necessary, the temperature of the material and the proportion of moisture.

The material introduced through the orifice 13 and containing, for example, 30% by weight of water, is transported downstream by the rotation of the screws 11 and 12 and is subjected to intense malaxation, with progressive compression and at the same time a rise in temperature. The larger part of the water can be removed in the form of steam through the upstream end and through the inlet orifice 13, another part being entrained with the solid phase.

At the down-stream end, the two screws 11 and 12 are provided with a restraining zone 15 which can be constituted by threads with a close or reverse pitch provided preferably with ports 150 allowing the passage downstream of a controlled flowrate of material, so as to cause a rise in pressure of the material up to a predetermined value. Thus, at the outlet 16 from the hydrolysis extruder 1, the material can reach, for example, a pressure higher than 30 bars. The temperature being of the order of 240° C., this pressure is higher than the saturated vapour pressure of water which thus remains mixed in liquid form with the solid residues constituted essentially by lignin. The glucose formed by hydrolysis remains dissolved within the extruded mixture.

According to the essential feature of the invention, the hydrolysis extruder 1 discharges at its outlet 16, into the middle part of an ouput extruder 4 arranged transversely to the hydrolysis extruder and comprising a sleeve 40 within which are driven in rotation two parallel screws 41 and 42 whose axes are preferably located in a plane perpendicular to the axes of the two screws 11 and 12.

Figure 2:
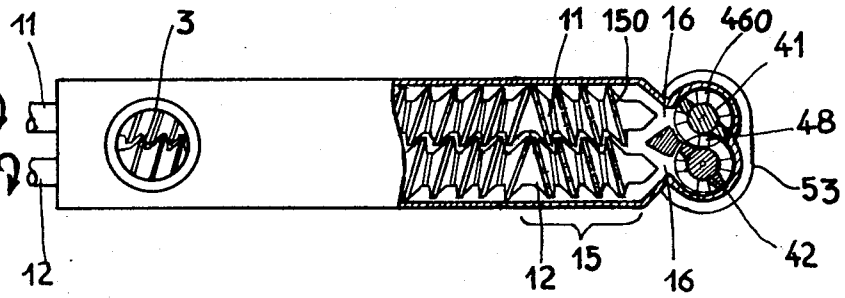
FIG. 2 is a plan view, in section along the line II—II of FIG. 1.

To avoid dead zones, it may be advantageous, as is shown in FIG. 2, to position a convergent element 16 in the axis of each screw 11 and 12, so that each discharges into a corresponding screw 41,42.

The sleeve 40 is provided at its downstream end, in the direction of transportation of the screws, with an extrusion die 43 and constitutes an enclosure fluid-tight at the pressure existing in the outlet orifice 16, the passages of the shafts of the two screws 41 and 42 being particularly provided with fluid-tight seals 49.

At its other end, upstream of the orifice 16, the sleeve 40 is provided on the other hand with an orifice 44 to which is connected an evacuation pipe 45 which is connected to an expansion chamber 5 through a pressure reducing valve 50.

In addition, the two screws 41 and 42 are provided, at their downstream end, with reversed pitch threads 46 provided with ports 460 permitting the passage downstream of a controlled flow rate of material. In this way the pressure rises to a value which may be comprised between 80 and 150 bars.

As a result the glucose paste emerging through the orifice 16 and taken up by the screws 41 42 of the output extruder 4 is subjected in the latter to a phase separation, the solid phase being drawn downstream whilst the liquid phase is expelled and becomes concentrated in the upstream part 47 of the extruder 4. This effect is due particularly to the use of an extruder with two screws preferably identical and rotated in the same direction.

In fact, when the screws are driven in the same direction, there occurs within each thread an accumulation of solid material upstream of the zone of engagement whilst the remaining part of the thread is relaxed. In fact, the material driven around the shaft by the rotation of the screw has a tendency to pass to the corresponding thread of the other screw but must, for this, pass through the engagement zone which has a narrower cross-section, which causes compression upstream. In proportion with the advance downstream, the material packs more and more into the threads which are completely filled with compressed material in the reverse pitch zone 46. However, in the part where the threads are not completely filled, the liquid phase expelled by compression of the solid phase gathers in the relaxed zones and can thus reascend from thread to thread in the upstream part 47 of the extruder. The solid material which could also have reascended upstream is sent back downstream due to the fact of the rotation of the screws which scrape each other mutually so that there only occurs, at the height of the outlet orifice 44, a concentrated syrup constituted by liquid phase containing dissolved glucose. The pressure-reducing valve 50 is regulated to maintain the pressure in the sleeve 40 at a value higher than the saturated vapour pressure so that the syrup is in liquid phase. A manometer 51 enables the pressure to be checked and the pressure reducing valve 50 consequently to be regulated.

At the downstream end, due to the fact of the use of co-rotating screws, it is possible to obtain sufficient fluid-tightness in the reverse pitch restraining zone 46. However, prudently, it is possible to arrange for the output extruder 4 to discharge into a convergent unit provided either with a single die 43 or with two dies each located respectively in the axis of one screw so as to form by extrusion a plug fluid-tight at the pressure existing in the sleeve 40.

In fact, due to the pumping effect resulting from the use of two co-rotating screws, it is possible to extrude a practically dry material.

According to an additional feature of the invention, it may be advantageous to introduce a liquid solution into the material, by means of an injection device (not shown) discharging at 56 in the sleeve 40, to adjust the temperature of the composition of the materials produced.

The use of two transverse extruders, one for hydrolysis the other for maintaining the pressure and the removal of the hydrolysed material has the considerable advantage of enabling separate regulation of the two extruders. Thus, the hydrolysis extruder 1 may be regulated by taking into account only the conditions of realisation of the hydrolysis reaction, the pressure being maintained by the output extruder 4 and determined by the adjustment of the pressure reducing valve 50; the speed of the screws of the output extruder 4 is regulated permanently to be adjusted to the viscosity and to the flow-rate of the material emerging from the orifice 16 to obtain in the die 43 a plug of compressed material fluid-tight at the pressure existing in the output extruder 4. The drained material emerging from the latter only contains a very small amount of sugar which can be recovered later, the greater part of the glucose remaining dissolved in the syrup which is removed through the pipe 45 into the expansion chamber 5. In the latter, the liquid phase is evaporated and is removed through the chimney 52 whilst the solution is condensed on the walls of the expansion chamber 5. It is possible thus to establish an equilibrium state, the extrusion conditions being regulated separately in each screw by monitoring the different parameters, temperature pressure, concentration of the syrup at the outlet, viscosity and water content of the solid residues, etc.

The phase separation carried out, according to the invention in the output extruder 4 has also the advantage of withdrawing almost from its formation, the sugar contained in the liquid phase from the lignin contained in the solid phase and thus to reduce the risk of reversal of the reaction which can occur, to a certain extent, in other processes, when the sugar formed remains too long under the hydrolysis reaction conditions.

In addition, the use of a separate extruder for controlling the output of the material enables the latter to be thermally isolated from the hydrolysis zone and the temperature of the material at the outlet to be controlled. To this end, it is possible, as has been indicated, to inject into the material being processed a fluid of selected temperature and composition but, if it is preferred to avoid dilution of the material, it is also possible to arrange along the sleeve 40 several cooling enclosures 53 traversed by a heat-removing fluid, for example one around the upstream portion and another around the downstream portion.

In the downstream portion, it is thus possible to regulate the temperature of the removed solid phase and to reduce further the risk of reversal of the reaction if it is feared that the dwell time should exceed a fixed limit, for example, 20 seconds.

In the same way, it is possible to cool the liquid phase contained in the upstream portion to facilitate relaxation whilst maintaining the pressure at the desired value.

Of course, the invention is not limited to the details of the embodiment which has been described, other modifications can be imagined whilst remaining within the scope of the claims.

We claim:

1. Process for hydrolysing cellulose material by passing the latter into an hydrolysis extruder comprising at least two parallel screws rotated within a sleeve in which the material introduced in the moist condition and transported by the screws between an inlet orifice and an outlet orifice placed at the two ends, respectively upstream and downstream of the sleeve, is malaxated and heated until it reaches a temperature above 200° C. in the downstream part of the hydrolysis extruder where it is contacted with an acid solution, and progressively compressed, the outlet orifice being provided with a control device for the evacuation of the hydrolysed material and which can maintain at the outlet of the hydrolysis extruder a pressure higher than the saturated vapour pressure of the liquid phase of the hydrolysed material at the temperature reached in the downstream part, said process comprising effecting in the control device for evacuating the material, a separation of the liquid phase and of the solid phase of the hydrolysed material with maintenance of the outlet pressure, by using for this purpose an output extruder comprising two screws whose axes are perpendicular to that of the hydrolysis extruder and rotated within a sleeve into the central part of which the hydrolysed material coming from the hydrolysis extruder discharges and in which a pressure is maintained higher than the saturated vapour pressure of the liquid phase by regulating the extrusion characteristics to form, at the downstream end of the output extruder, a plug of compressed material fluid-tight at said pressure, the latter being regulated by means of a pressure reducing valve controlling the removal of the concentrated liquid phase in the upstream part of the output extruder and in which the glucose formed by hydrolysis is dissolved.

2. Hydrolysing process according to claim 1, comprising separately regulating the rotary speeds of the screws of the two extruders, respectively the hydrolysis extruder and the output extruder.

3. Hydrolysing process according to claim 1, comprising maintaining at the outlet of the hydrolysis extruder and in the output extruder a pressure above 30 bars.

4. Hydrolysing process according to claim 3 wherein said pressure is 35 bars.

5. Hydrolysing process according to claim 1, comprising cooling the downstream part of the output extruder so that the solid phase removed is at a temperature which does not allow the degradation of the sugars and/or the inversion of the hydrolysis reaction.

6. Hydrolysing process according to claim 1 or 5, comprising adjusting the composition of the material produced by injection of a liquid solution into the sleeve of the output extruder.

7. Hydrolysing process according to the claim 1 or 5, comprising adjusting the temperature of the material produced by injection of a cooling fluid into the sleeve of the output extruder.

8. Hydrolysing process according to claim 7, comprising adjusting the composition of the material produced by injection of a liquid solution into the sleeve of the output extruder.

9. Device for hydrolysing cellulose material, constituted by an hydrolysis extruder comprising at least two parallel screws rotated within a sleeve which envelops them, the material introduced in the moist condition through a feed orifice placed at the upstream end of the sleeve and transported by the screws to the downstream end, being subjected in the course of its transport to heating to a temperature above 200° C. and to malaxation with progressive compression to a pressure above the saturated vapour pressure of the liquid phase at the temperature reached at the downstream end and maintained by a control device for the evacuation of the material closing the downstream end of the hydrolysis extruder, wherein the device for controlling the evacuation under pressure of the hydrolysed material is constituted by an output extruder positioned transversely to the hydrolysis extruder and also comprising at least two screws rotated within a sleeve constituting a fluid-tight vessel provided, in its central part, with at least one inlet orifice for the hydrolysed material coming from the hydrolysis extruder, at its downstream end in the direction of transportation of the screws, with a restraining zone for the removal of the solid phase of the material in the form of a continuous plug fluid-tight at the pressure reached in the sleeve and at its upstream end, with an orifice for removing the liquid phase expelled by the compression and containing the dissolved glucose, said upstream orifice being closed by a pressure-reducing valve regulated to a pressure higher than the saturated vapour pressure.

10. Hydrolysing device according to claim 9, wherein the output extruder is provided at its downstream end with at least one extrusion die.

11. Hydrolysis device according to claim 9, wherein the hydrolysis extruder is provided at its downstream end with two convergent elements each positioned in the axis of a screw and discharging into the central part of the output extruder.

12. Hydrolysing device according to claim 9, wherein the pressure reducing valve is placed in a pipe connecting the evacuation orifice to a expansion chamber in which the liquid phase is evaporated, the glucose being condensed on the walls.

13. Hydrolysing device according to claim 9, wherein the output extruder is provided with a cooling vessel surrounding the downstream part of the sleeve.

14. Hydrolysis device according to claim 9 or 11 wherein the output extruder is provided with a cooling vessel surrounding the upstream part of the sleeve in which the liquid phase containing the dissolved glucose is concentrated.

* * * * *